United States Patent [19]

Szabad, Jr.

[11] Patent Number: 4,850,913

[45] Date of Patent: Jul. 25, 1989

[54] SPORTS BOARD HAVING A SLICK FILM SURFACE AND METHOD FOR MAKING

[75] Inventor: Robert F. Szabad, Jr., Carlsbad, Calif.

[73] Assignee: Packaging Industries Group, Inc., Hyannis, Mass.

[21] Appl. No.: 98,396

[22] Filed: Sep. 18, 1987

Related U.S. Application Data

[63] Continuation-in-part of Ser. No. 36,662, Apr. 10, 1987, abandoned.

[51] Int. Cl.[4] ..... A63C 15/00

[52] U.S. Cl. ..... 441/65; 114/357; 280/18; 280/845; 428/314.4; 428/315.9; 428/316.6; 428/317.3

[58] Field of Search ..... 441/65, 68, 74; 114/357, 39.2; 428/318.8, 314.4, 315.9, 316.6, 317.3; 280/18, 845

[56] References Cited

U.S. PATENT DOCUMENTS

| | | | |
|---|---|---|---|
| 3,070,817 | 1/1963 | Kohrn et al. | 114/357 |
| 4,129,911 | 12/1978 | McDonald et al. | 441/74 |
| 4,457,729 | 7/1984 | Peerlkamp | 441/74 |
| 4,571,195 | 2/1986 | Brooks, Jr. | 441/74 |

*Primary Examiner*—Sherman D. Basinger
*Attorney, Agent, or Firm*—Berman, Aisenberg & Platt

[57] ABSTRACT

A sports board for surfing, snow sledding, and other sports, has a shaped polyethylene foam core to which a polyethylene film/polyethylene foam sheet laminate is heat laminated over substantially all the surfaces of the core. Frictional resistance between the board and surfaces on which the board is used is reduced, and the slick film outer skin provides an impervious outer surface to the board which resists puncturing and water absorption by the board.

9 Claims, 1 Drawing Sheet

FIG. 1
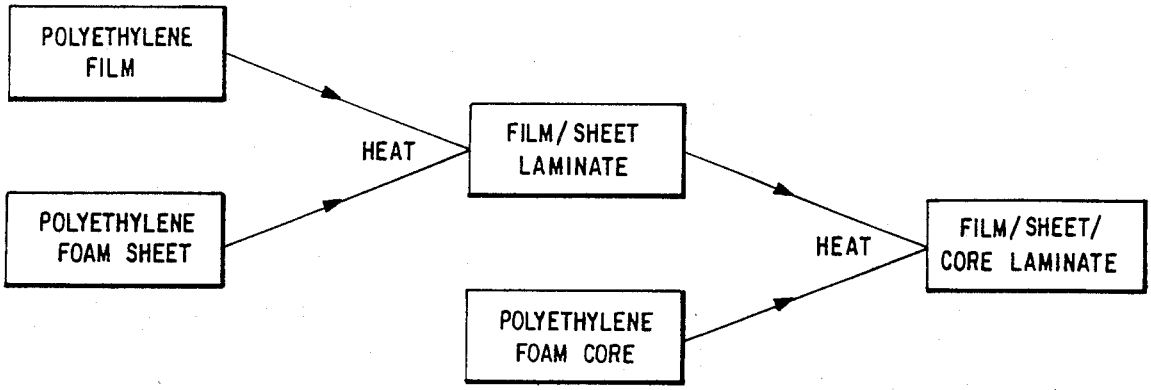
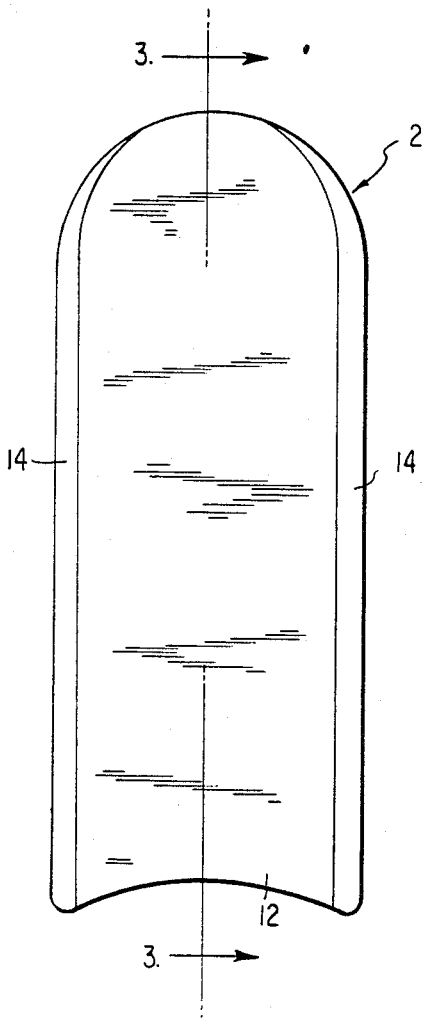
FIG. 2
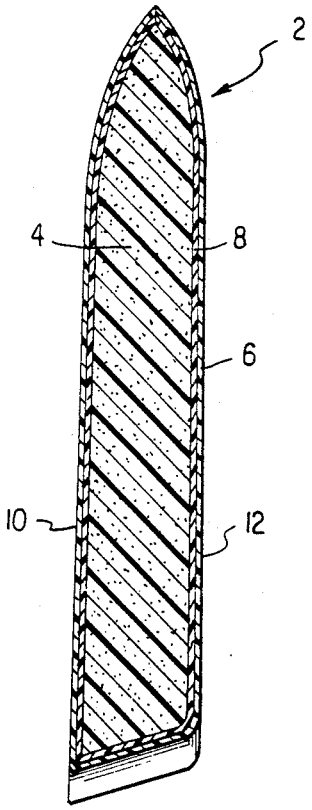
FIG. 3

SPORTS BOARD HAVING A SLICK FILM SURFACE AND METHOD FOR MAKING

RELATED APPLICATION

This application is a continuation-in-part of copending application Ser. No. 36,662, filed Apr. 10, 1987, now abandoned.

FIELD OF THE INVENTION

The invention concerns a polyethylene foam board used as a body board, surf board or other board for water sports or for snow skiing, sledding or other snow sports.

BACKGROUND OF THE INVENTION

The use of a foam board as a body board, surf board, water ski, snow sled or other recreational board is well known. Presently used sports boards of this type have at least two disadvantages. Firstly, present boards are insufficiently slick and do not have good gliding characteristics either through the water or on snow, and secondly, presently used boards are easily punctured and absorb water, making the board unduly heavy.

Polyethylene foam boards are known in the art, and have polyethylene foam sheet laminated to a polyethylene foam core. Known boards may have a lower surface of Surlyn, an ionomer sheet material manufactured by E.I. Du Pont and Company, Limited. While Surlyn provides a smooth finish to the lower surface of the board, it cannot be applied to either the deck or the edges of the board since it cannot be satisfactorily adhered to curved surfaces.

SUMMARY OF THE INVENTION

A sports board of the invention is used for water sports, snow sports, and other uses, and has a shaped core of closd-cell polyethylene foam to which a laminate of a denser closed-cell polyethylene foam and polyethylene film is heat laminated. The film/foam laminate is made by heat lamination and is adhered to the deck surface, lower surface and edges of the board, thus encasing the board with the laminate. The polyethylene film is positioned as the outer surface of the board, and provides a slick surface over substantially the whole board, facilitating movement of the board through water or snow. The slick, glossy polyethylene outer film surfaces is resistant to puncturing, thus preventing water absorption by the board.

BRIEF DESCRIPTION OF THE DRAWINGS

FIG. 1 is a schematic flow diagram of the method of making the foam board of the invention.

FIG. 2 is a bottom plan view of a board of the invention, showing the edge strips.

FIG. 3 is a cross-sectional view taken on line 3—3 of FIG. 2.

DETAILED DESCSRIPTION OF THE INVENTION

The polyethylene foam board of the invention has a slick outer skin over substantially all of its surface providing greatly improved performance in the water or on snow. In manufacturing boards for aquatic or snow sports, surface slickness is a great advantage, but until now it has not been possible to provide surface slickness on all surfaces of a soft polyethylene foam core board. Slick surfaces have previously only been possible on rigid fiberglass boards. The boards of the invention have a foam core and are "soft boards".

The slick surface on the deck, underside and side rails of the board creates less drag and promotes quick release from the surface of the water, snow, ice, grass, or other surface on which the board is used. The board has improved performance, superior cosmetic appearance, ability to receive permanent color impregnation of a logo, ability to receive dry adhesive traction material, decreased water absorption by the board, and other benefits.

In a preferred embodiment of the invention, a polyethylene foam board has a shaped core of closed-cell polyethylene foam planking which has a density of about 1 to 10 pcf, and preferably a density of about 2 to 4 pcf. The core may either be made from a single piece of foam planking cut to shape, or may be composed of a laminate of a plurality of foam sheets either heat laminated to each other, or laminated by other methods known in the art such as polyethylene film lamination. A laminated core is cut to shape similarly to a one-piece core.

The method used for making the board is shown schematically in FIG. 1. A polyethylene film/foam laminate is prepared by heat-laminating a sheet of polyethylene film to a sheet of polyethylene foam. The polyethylene film, which forms the outer skin of the board is suitably about 1 to 100 mils in thickness, and preferably about 10 to 50 mils in thickness. This film is heat-laminated to a polyethylene closed-cell foam sheet having a density of about 1 to 10 pcf, and preferably about 4 to 8 pcf. The most preferred density is about 6 pcf. The film may be clear or may be colored during its manufacture. The film is heat laminated to the foam sheet at about 400° F., as known in the art, and the film/foam laminate is air cooled and taken up on rolls. The foam core and the film/foam laminate are then each heated to about 400° F. on the foam surfaces to be laminated together. The closed-cells on these surfaces open under the influence of heat, and the surfaces are brought together under compression. The heat and pressure enable a laminate to be formed. The core is then reversed and the unlaminated side is heated and another sheet of film/foam laminate is similarly laminated thereto. A film/foam sheet is subsequently laminated to the exposed side edges of the board, thus substantially encasing the core in film/foam laminate. The edge strips are also applied by heat lamination and compression. The prssure may be applied by hand, iron, roller or other method known in the art. The board is air-cooled.

Additional color patterns may optionally be incorporated into the film/foam laminate by adding color concentrate in a pattern configuration to the film surface immediately prior to lamination to the foam sheet. This provides a similar pattern configuration on the board. For example, the color may be applied between the film and foam during the lamination process when the film and foam sheets have both been unwound from rolls and exposed to heat and are travelling toward the nip of pressure rolls. As the heated sheets pass through the nip of the pressure rolls, heat lamination takes place. Color concentrate added onto the surface of the film is spread to form an elongated pattern of stripes of waves on the board. Varying colors may be used in combination.

The completed board may have the same or differently colored skins on its outer surface according to choice. The outer polyethylene film skins are slick to touch and glossy in appearance and are substantially impervious to the elements.

A logo may be permanently applied to the deck and/or bottom of the board. In a non-limiting example, a logo may be permanently applied to the polyethylene film outer layer, using heat and pressure on a Mylar transfer pattern made specially for application to polyethylene (Mylar is a polyester film, made by E.I. DuPont & Company, Ltd.)

A foam board of the invention is slick to the touch and particularly when it is wet, the board is slippery to feel. In order to provide good frictional adhesion, dry adhesive traction material or wax may be applied. The dry adhesive traction material is particularly suitable for applying to the top deck of the board, either substantially over the whole surface of the deck or in particular areas, as appropriate. Dry adhesive or wax may also be applied around the edges of the board to facilitate handling. Traction material on the board facilitates a good grip by the user without impairing the functional advantages of the slick surfaces of the board. Dry adhesive material, which may be sheet material having a watertight frictional surface with a backing of the dry adhesive material, may be removed from the board surface and replaced, if necessary, without damaging the slick, glossy surface of the board. Suitable dry adhesive is made by Astro-Deck and Trac-Top.

Prior known boards are easily punctured, either accidentally or by long use. When the surface of a board has been punctured, water enters the body of the board, and is absorbed, making the board heavy and difficult to use. The slick polyethylene film skin is resistant to puncturing and impervious to water. Water absorption by a board of the invention is substantially decreased over that of known boards.

The materials and design of the board combine synergistically to provide a slick board with excellent performance characteristics since frictional resistance is decreased and loss in velocity as the board moves through the medium is minimized by use of the glossy, non-absorptive surface over substantially the entire board.

With reference to FIGS. 2 and 3, in which like numerals represent like parts, board 2 has foam core 4 to which a film/foam laminate comprising polyethylene film 6 heat laminated to a sheet of polyethylene foam 8 is adhered by use of heat and pressure. The film/foam laminate substantially covers the board over its top surface 10, bottom surface 12, and edges 14.

Appropriate materials for the core include polyethylene foam, polypropylene foam, polyurethane foam, and Arcel foam (made by Atlantic Richfield Co.) or the core may be of wood or metal. Polyethylene foam is the preferred material. The outer film sheet is preferably polyethylene film laminated to a sheet of polyethylene foam. The polyethylene foam sheet provides strength and cushioning to the film, and the film/foam laminate formed therefrom is laminated to the core of the board to provide a board having a smooth, glossy surface which glides easily through water or on snow, grass, or other surfaces.

The performance characteristics of the board may be varied by varying the density of the foam core, foam sheet and/or film, as known to one skilled in the art. For example, a typical body board has a 30 mil thickness of polyethylene film forming the skin on the deck of the board and the bottom of the board, and a 15 mil thickness of film as the outer glossy surface on the edges of the board. A stiffer board is provided if either the foam core has a greater density and/or if the film skins have a greater density and/or thickness. The degree of flex of the board is also controllable by varying the thicknesses of the foam core and skin, a greater degree of flex being provided by use of less dense foams and thinner films. In particular, thickness of the film outer skin is determinative of flexibility of the board.

In balancing the properties required, the strength of the product must also be considered, and in general, heavier, thicker materials provide the advantage of greater strength, but the disadvantage of greater weight and stiffness.

While the invention has been described above with respect to certain embodiments thereof, it will be appreciated that variations and modifications may be made without departing from the spirit and scope of the invention.

What is claimed is:

1. A soft sports board for skimming over water or snow comprising a preformed, preshaped foam core, and polyethylene film means comprising a sheet of polyethylene film laminated to a sheet of polyethylene foam, said polyethylene foam sheet having a greater density than said foam core, said polyethylene film means being laminated to outer surfaces of the preformed, preshaped foam core of said board to substantially completely cover the outer surfaces of the core, wherein the foam sheet is laminated to the foam core and the film sheet provides an outer glossy, impervious polyethylene film surface for reducing friction and decreasing water absorption of the board.

2. A board of claim 1 wherein the core comprises a member selected from the group consisting of polyethylene foam, polypropylene foam, polyurethane foam, Arcel foam.

3. A sports board of claim 1 wherein said impervious surface further comprises traction material applied to said surface.

4. A sports board of claim 3 wherein said traction material is dry adhesive traction material.

5. A soft sports board for skimming over water or snow comprising a preformed, preshaped polyethylene foam core, and a laminate comprising a polyethylene foam sheet of greater density than the foam core heat laminated to a polyethylene film sheet, said laminate comprising a foam face and a film face, the foam face of said laminate being heat laminated to the preformed, preshaped polyethylene foam core and the film face of said laminate forming a slick outer skin for said board, wherein the core is substantially covered by sheets of the laminate.

6. A sports board of claim 5 further comprising dry adhesive traction material applied to said slick outer skin.

7. A method for making a soft shaped sports board for skimming over water or snow comprising:

heat laminating a polyethylene film to a polyethylene foam sheet to form a film/foam laminate having a foam surface and a film surface, and heat laminating the foam surface of the film/foam laminate to a preformed, preshaped polyethylene foam core having a lower density than that of the polyethylene foam sheet, whereby the film surface provides a glossy outer surface for the board.

8. A method of claim 7 wherein the heat laminating takes place at a temperature of about 400° F.

9. A method of claim 7 further comprising applying dry adhesive traction material to the glossy outer surface.

* * * * *